United States Patent [19]

Vinas

[11] Patent Number: 4,727,626

[45] Date of Patent: Mar. 1, 1988

[54] CONTROL OF FIBERS IN APRON DRAFTING SYSTEMS OF MACHINERY USED IN THE SPINNING PROCESS

[75] Inventor: D. Ricardo M. Vinas, Barcelona, Spain

[73] Assignee: Platt Saco Lowell S.A., Greenville, S.C.

[21] Appl. No.: 809,610

[22] Filed: Dec. 16, 1985

[30] Foreign Application Priority Data

Dec. 14, 1984 [ES] Spain ..... 539.294

[51] Int. Cl.[4] ..... D01H 5/86

[52] U.S. Cl. ..... 19/244; 19/249; 57/315

[58] Field of Search ..... 19/244, 248, 249, 250, 19/251, 252; 57/297, 90, 315

[56] References Cited

U.S. PATENT DOCUMENTS

| | | | |
|---|---|---|---|
| 2,686,938 | 8/1954 | Noguera | 19/251 X |
| 2,774,995 | 12/1956 | Sandelin | 19/250 X |
| 3,055,060 | 9/1962 | Schitknecht | 19/251 X |
| 3,636,591 | 1/1972 | Herubel | 19/248 X |
| 4,391,021 | 5/1983 | Kamel . | |

FOREIGN PATENT DOCUMENTS

| | | | |
|---|---|---|---|
| 1022134 | 1/1958 | Fed. Rep. of Germany . | |
| 1118072 | 9/1961 | Fed. Rep. of Germany . | |
| 1382701 | 11/1964 | France | 19/249 |
| 208725 | 2/1940 | Switzerland . | |
| 295358 | 12/1953 | Switzerland . | |
| 360932 | 4/1962 | Switzerland . | |
| 385687 | 3/1965 | Switzerland . | |
| 700221 | 11/1953 | United Kingdom | 19/249 |
| 847300 | 9/1960 | United Kingdom | 19/249 |

*Primary Examiner*—Louis K. Rimrodt
*Assistant Examiner*—Judith L. Olds
*Attorney, Agent, or Firm*—Cort Flint

[57] ABSTRACT

An improved fiber control for an apron drafting system of a spinning frame is disclosed which includes a rear pair of rolls (3, 6) a middle pair of rolls (2, 5), and a front pair of rolls (1, 4). A silver guidance zone is formed between upper apron 8 and lower apron 11 around rolls 5 and 2, respectively by which sliver is guided in a prescribed path. The guidance path may be configured especially to the fiber type and length by transverse projection elements (17, 18, 19) which engage lower apron 11 and are displaceable. The projection elements are displaceable perpendicular to and along the length of the sliver guidance zone and may be made to contact lower apron 11 to provide a desired shape for control of the sliver.

9 Claims, 5 Drawing Figures

PRIOR ART

Fig. 3.
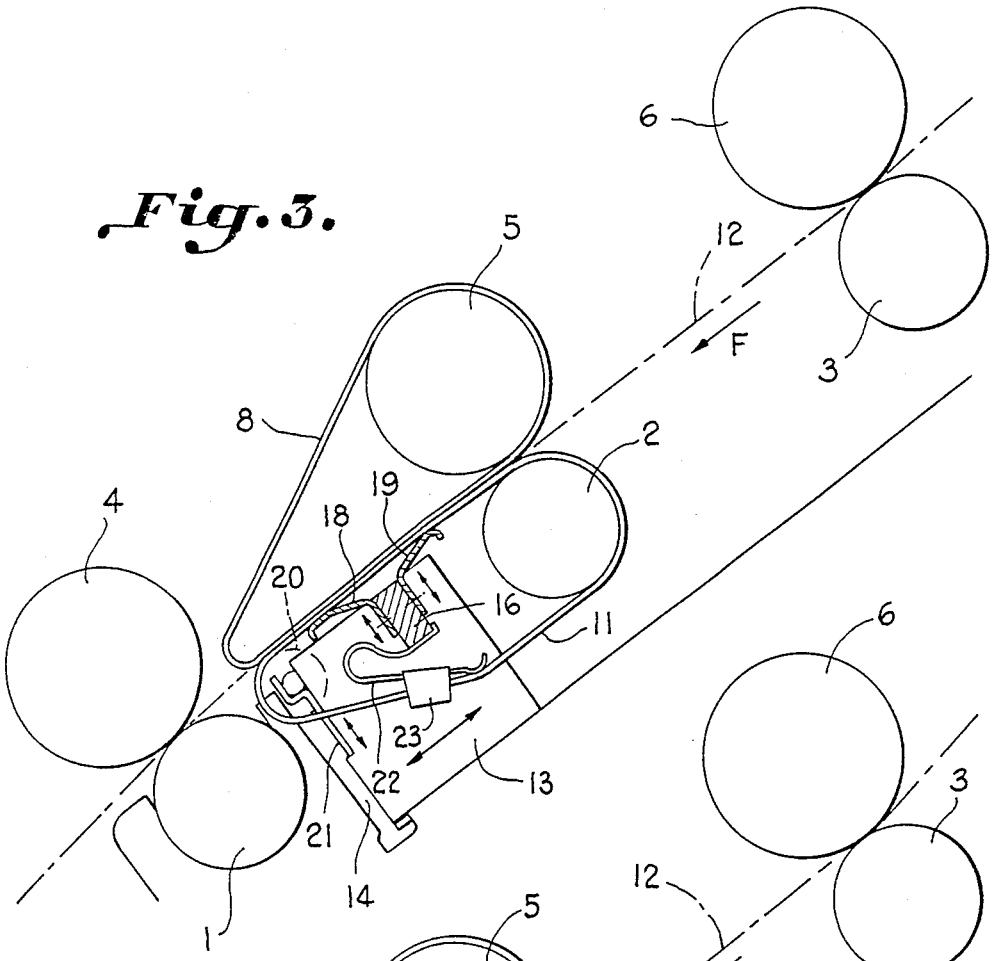
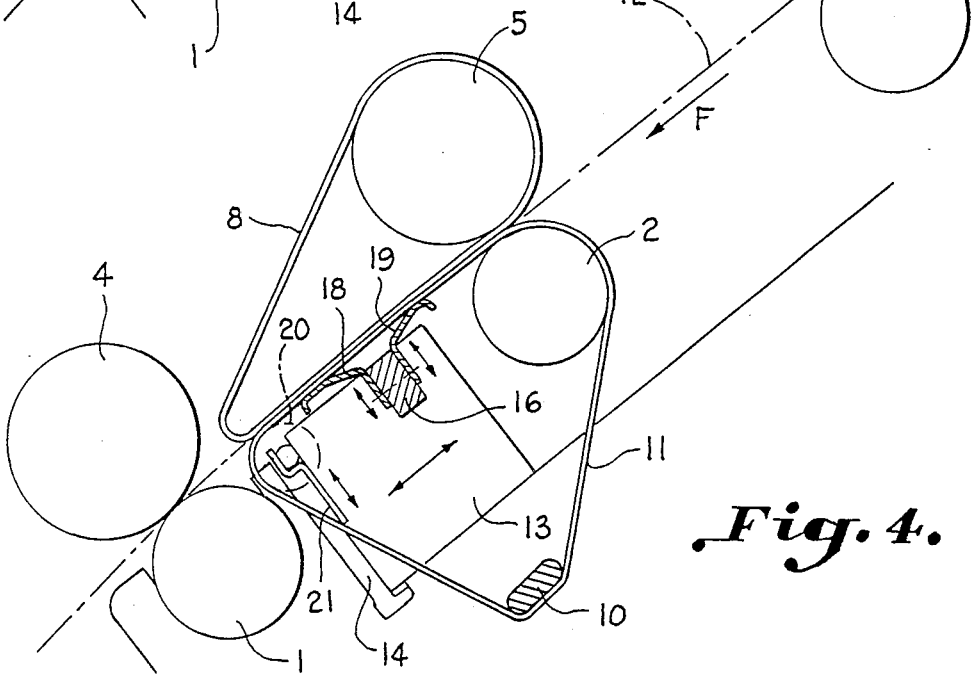
Fig. 4.

CONTROL OF FIBERS IN APRON DRAFTING SYSTEMS OF MACHINERY USED IN THE SPINNING PROCESS

BACKGROUND OF THE INVENTION

The present invention relates to the improved control of fibers in apron drafting systems of machines used in the process of spinning, especially the spinning frame and the roving frame.

As is already known, the roving of sliver which feeds the machine is subjected to drafting in one or more consecutive zones, which includes a prior back drafting between several pairs of rolls, and a front drafting between several other pairs of rolls. There is a pair of front rolls between which the roving or sliver is finally drafted and guided between both pairs of rolls by means of sundry aprons, both top and bottom constituted of corresponding elements in the style of conveyors.

Each type of fiber presents determined lengths, and in order to avoid breakage of the fibers constituting the roving or sliver, the distance between the pairs of rolls had to be adjusted. More particularly, the distance between the front pair of rolls and the point or face of contact between the top and bottom aprons need be adjusted due to the fact that the effect of the pairs of rolls is to nip (or pinch) the surface of the roving fibers.

Up to the present time, in order to avoid this breakage of the fibers, obtain the maximum control of the fibers, and attain perfect uniformity of the yarn, a method has been used of elevating or lowering the top apron by the front part. By this, a separation or space is produced between the top and bottom aprons which does not permit adequate control of the roving fibers.

The present invention provides improved control of the fibers and permits obtaining different intensities of control of the fibers at different points within the drafting zone. This permits adjustment of the control of the fibers in accordance with required conditions. The control points can be adjusted independently in accordance with the type and length of fibers, permitting numerous combinations to obtain an effective control for all types of fibers.

SUMMARY OF THE INVENTION

The present invention utilizes a profiled projection which engages the bottom apron in the zone guiding the roving of fibers between the top and bottom aprons in the front drafting section. The projection is transverse to the movement of the sliver and produces active contact of the two aprons between which the sliver is passing. The transverse projection is movable within the bottom apron along the length of the guiding zone in right-angled direction and parallel to the movement of the sliver. This may determine a desired configuration between the two aprons which defines the sliver guiding zone.

According to the invention, the transverse projection is mounted immovably but at an adjustable distance with reference to the sliver guiding zone between both aprons. The projection has a length transverse to the zone which is adjustable along the length of in the zone. The profiled projection may be regulated in its position perpendicular to the zone by mounting the transverse projection at preestablished or progressive positions. Elongated projections may be held by bars fixed between two end supports which are alternatively movable longitudinally to said guidance zone. Preferably a transverse projection will have at least one longitudinal flange element transverse to the movement of the sliver which presents a flat portion contacting the apron. The element may consist of a profile or solid or hollow piece of whatever convenient configuration. A projection roll may be utilized and placed at the delivery end of the bottom apron. Finally, the improvements of the present invention foresee the disposition of various projection elements positioned longitudinally in the middle section of the guiding zone and a roll in the delivery end of said zone, within the bottom apron.

DESCRIPTION OF THE DRAWINGS

The construction designed to carry out the invention will hereinafter be described, together with other features thereof.

To facilitate a more detailed explanation and understanding of the invention, drawings are attached which represent a practical embodiment of the effects of the improvements of the present invention for purposes of illustration, but not limitation. Accordingly, in the drawings:

FIGS. 2, 3, 4 and 5 show various schematic views similar to that of FIG. 1, but which incorporate the improvements of the present invention.

DESCRIPTION OF A PREFERRED EMBODIMENT

Figure 1:
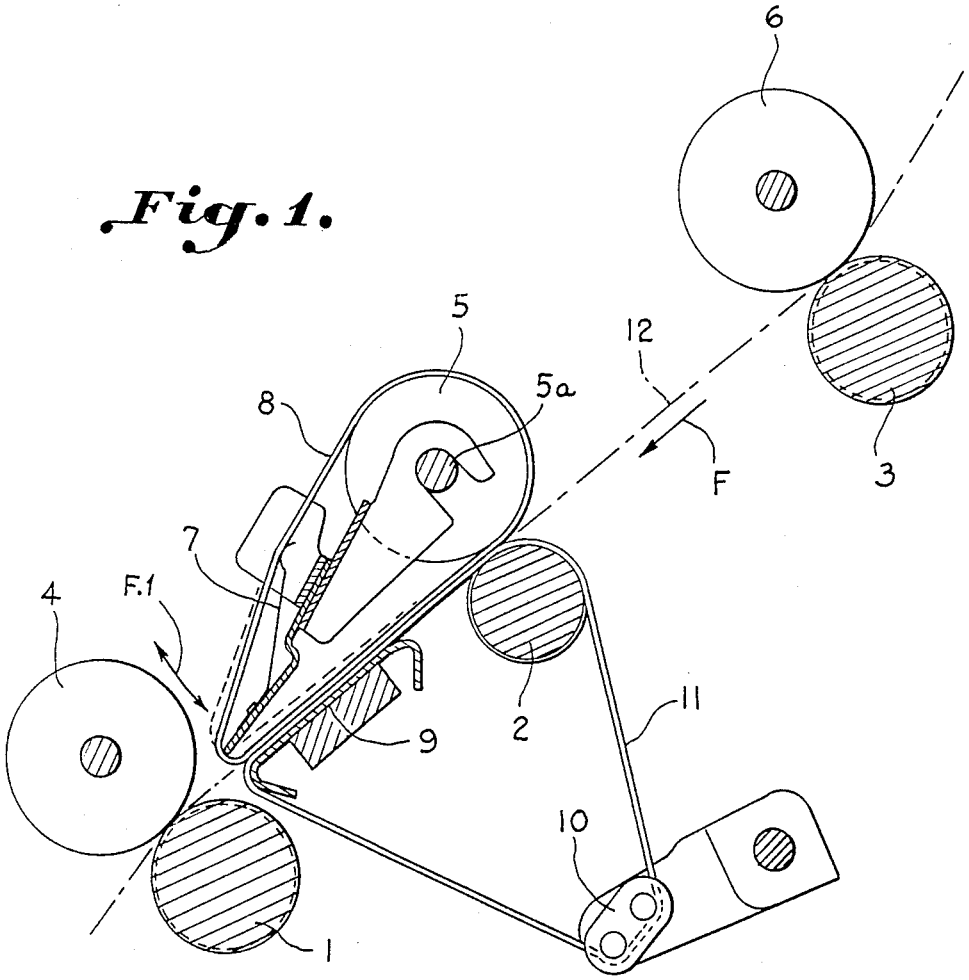
FIG. 1 is a schematic side view and section of an apron drafting arrangement according to known technology.

According to illustration in FIG. 1, and in a conventional manner, three actuating bottom rolls 1, 2, and 3 and three top pressure rolls 4, 5, and 6, respectively, define pairs of front, middle and rear rolls. A top apron 8 is carried around the second line top roll 5, an angular piece (not illustrated), and a conventional tensioning device 7 in the manner of a conveyor. A bottom apron 11 is formed around the actuating roll 2 over a fixed guide profile 9 and a conventional tensioning device 10 in the manner of a conveyor.

The roving fibers 12 proceeding from the bobbin positioned above, and flowing in accordance with the arrow F, pass between rolls 3 and 6, and between rolls 2 and 5. In this section between the roll pairs, the roving or sliver goes through back drafting due to the fact that rolls 2 and 5 revolve at a higher tangential speed than rolls 3 and 6, subjecting the sliver 12 to a drafting. The sliver, after being drafted, passes between rolls 1 and 4 which can also revolve at a tangential speed higher than rolls 2 and 5, subjecting the sliver 12 in this section to a front drafting. In this manner, the sliver 12 previously drafted receives with this final draft the proper twist.

Between rolls 2 and 5, and rolls 1 and 4, the sliver 12 is transported between aprons 8 and 11. The sliver fibers are subjected to a drafting when they are engaged by the front rolls, which causes them to slide between the surfaces of the two aprons which guide and control them.

In order to obtain an optimum quality and uniform yarn, it is necessary to be able to adjust the distance between the top and bottom aprons and the mutual separation between the aprons. This determines the intensity of control over the fibers in accordance with the type and length of fibers as well as other relative factors of the fibers.

Heretofore, as illustrated in FIG. 1, this adjustment has been obtained only by turning the top apron 8 over the shaft 5*a* of the roll 5 according to arrow F1 in order to increase or decrease the distance between the front rolls and the nipping or contact field between the top and bottom aprons. This has been done to ensure proper operating conditions for drafting of the fibers, which determines the control of the fibers in the drafting zone.

As demonstrated by practical experience, the control of the fibers in the roving according to the prior arrangement has not been obtained with the necessary precision. If the top apron 8 is turned slightly with respect to the bottom apron 11, the field of contact between the two aprons 8 and 11 is reduced practically to the nipping point between the two rolls 2 and 5. Therefore the control zone of the fibers cannot be properly regulated.

Referring now to FIGS. 2 through 5 of the drawings, the improvements and performance of this invention are illustrated. In the Figures, the same reference numbers are used for the same elements.

Figure 2:
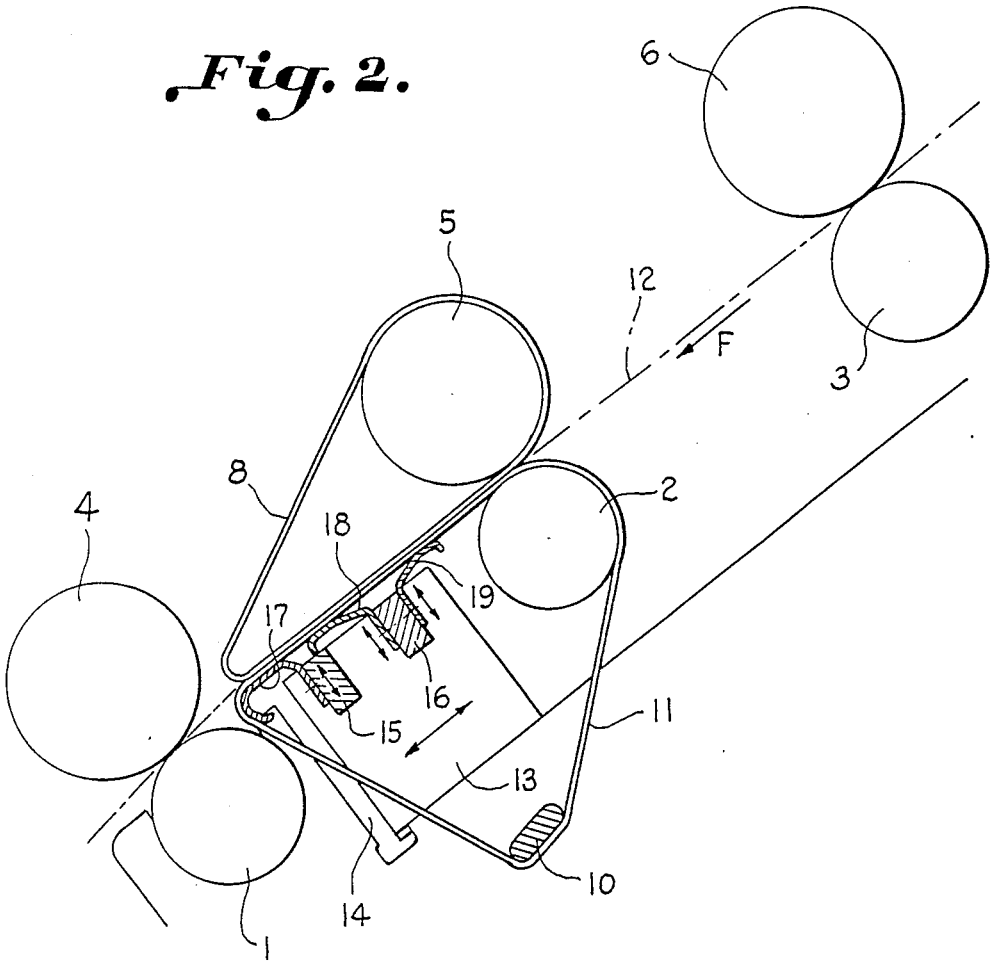

As can best be seen in FIG. 2, the bottom actuating rolls are illustrated as 1, 2, and 3 and the top conventional pressure rolls 4, 5, and 6, with the top and bottom aprons 8 and 11 respectively.

Bottom apron 11 is mounted on actuating roll 2 which drives the apron following a path guided by projections 17, 18, and 19. The apron is tensioned by the action of a conventional device 10. Projections 17, 18, and 19 are mounted in a stationary manner on bars 15 and 16 transverse to the aprons. Bars 15, 16 are affixed even with the saddles or supports 13 on conventional ends which are alternatively movable on the respective roll stands of the frames in a conventional manner. When necessary, they give the profiled projections alternative movement longitudinally to the roving guidance zone in order to change the position. These projections are also movable at right angles to the direction of the movement of the sliver to permit also changing the position with regard to the guidance zone of the sliver and guidance of the apron. The bars support several bottom aprons 11 aligned consequently and affixed at the ends even with the saddles or supports 13, as indicated.

Projection 17 is mounted on bar 15 at the delivery end of the bottom apron 11 and the two projections 18 and 19 are mounted on bar 16 occupying the middle section of the guiding zone between the two aprons 8 and 11. The profiled projections 17, 18 and 19 present substantially an L configuration having one arm which constitutes the main part and permits the affixing to the bar. The other arm constitutes a flange which presents a flat longitudinal surface which establishes contact with the apron 11. The above mentioned projections 17, 18, and 19 are mounted on bars 15 and 16 in preestablished positions according to the holes in the main part of the projection and conventional fasteners (not illustrated). This permits the exact alignment of the profiled projections of the bottom aprons with all of the drafting system of the frame.

The above mentioned arrangements allow variations of the active points of contact between aprons 8 and 11 which can vary the elevation of the points of contact between the aprons. This varies the configuration of the guidance path between the two aprons in the nipping zone controlling the fibers. Adjustment of the fiber control may be had in the operation of drafting of the sliver since it is possible to obtain a trajectory or path which is curved, wavy or straight, as desired, and obtain more or less a retaining of the fibers of the sliver through all its length.

FIGS. 3 and 4 show another embodiment based on a short and a long bottom loop, respectively. As differentiated with regard to FIG. 2, instead of projection means 17, a roll 20 is held by a support 21 mounted stationary in preestablished positions with respect to saddle 13 in the same manner as profiles 18 and 19.

The only difference between the long and the short bottom loops 11 of FIGS. 3 and 4, consists in the application of a conventional tensioning device by means of a laminated spring 22 in combination with a guide 23, in FIG. 3, and by means of a tensioning device 10 in FIG. 4 as in FIG. 2.

Figure 5:
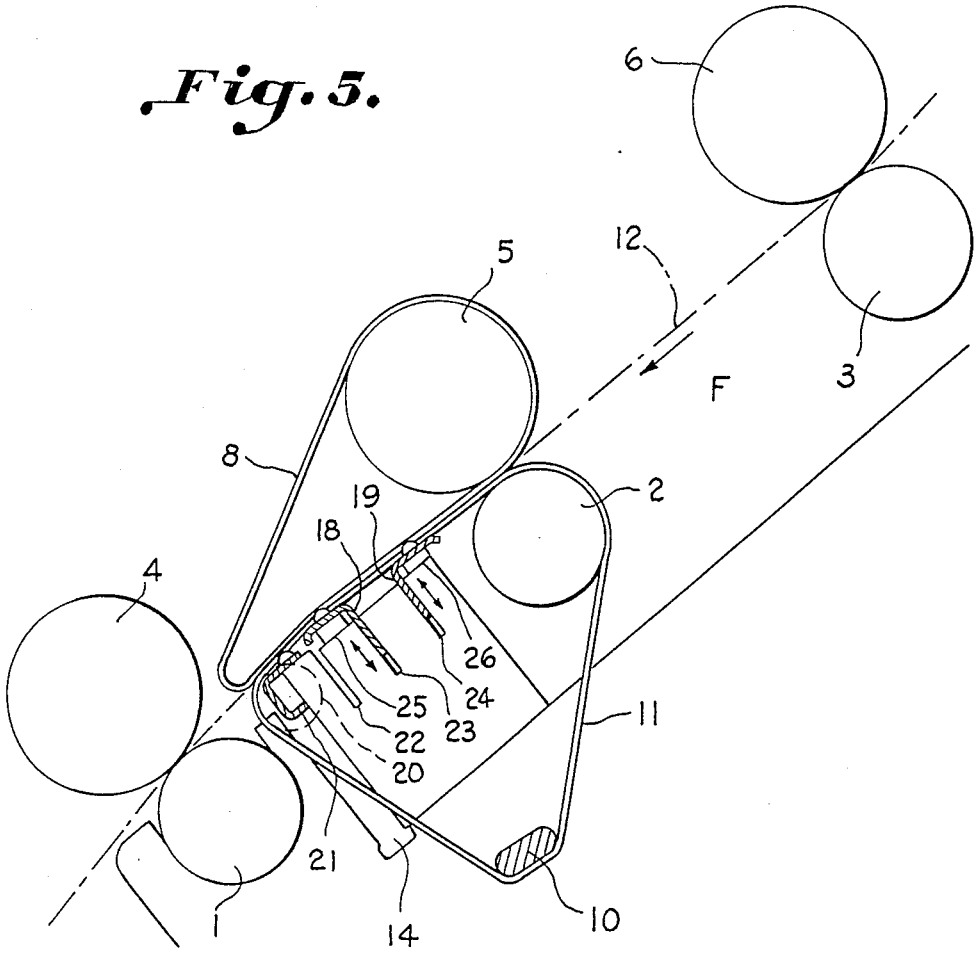

With regard to the embodiment illustrated in FIG. 5, it is the same as that illustrated in FIGS. 2 and 4, incorporating a roll in the delivery end as in FIGS. 3 and 4, although it could also incorporate only projection elements as in FIG. 2. In FIG. 5, roll 20 and projections 18 and 19 are affixed by means of mount support 21 directly on to the saddles or end supports 13, in place of affixing 15 and 16 to the bars as in FIGS. 2 and 4. The projections 18 and 19, and in some cases 17, are fitted by the main arm in the respective grooves 23, 24, and in some cases 22, provided in the saddles or supports 13. Both the support 21 of the roll 20 as well as the profiles 18 and 19 are mounted in a preestablished position by means of supplements 25, 26, etc., of a proper thickness in the sliver guiding zone. This advantageously affixes the projections with supplements to the saddles. The arrangement of FIG. 5 presents a notable advantage over FIGS. 2 and 4 with regard to the facility with which changes can be made in the preestablished positions of the projections. It is not necessary to remove the apron, or more exactly the various aprons, mounted between the two saddles or opposing end supports 13. This is because it is not necessary to manipulate the apron but only change the supplements which can be done from the outside of the apron and more exactly the saddles, as indicated above.

In the illustrated operations the conventional saddles or supports provided with the machine have been used to give the transverse projections alternate longitudinal movement relative to the guidance zone. However, an attachment which furnishes the alternate movement may also be utilized if necessary.

The provision of one or various transverse projections movable parallel and at right angles to the movement of the sliver are the objective of the invention. The projections may include the projection elements or the roll incorporated on the inside of the bottom apron 11. Modification of the active contact and the trajectory between the top apron 8 and the bottom apron 11 is permitted, guiding the previously drafted sliver. The points of control and drafting of the sliver may be regulated in the area between the two aprons. The points of contact and guidance path determined by the aprons may be adopted to the type and length of fiber. Although not illustrated, it is to be understood that the improvements of this invention for graduating by degrees, or in a progressive manner.

Also, the present improvements foresee that the bottom apron can incorporate several transverse projections which can be arranged on different planes. The sliver conducted between the two aprons will describe a trajectory according to any desired configuration, be it curved, wavy, or straight.

In the same manner, the profiles can be constructed of solid or hollow parts and can have the surface either open or closed or of any configuration desired, and can also be revolving.

While a preferred embodiment of the invention has been described using specific terms, such description is for illustrative purposes only, and it is to be understood that changes and variations may be made without departing from the spirit or scope of the following claims.

What is claimed is:

1. In an apron drafting system of a spinning frame of the type which includes a back draft between a first pair of rolls and a second pair of rolls, a front draft between said second pair of rolls and a third pair of front rolls wherein between said pairs of rolls the roving or sliver is drafted, a guidance zone defined between said second and third pairs of rolls by a top apron and a bottom apron, wherein the improvement comprises an improved fiber control which includes a projection means carried in engagement with said bottom apron in said guidance zone which includes at least one projection element carried transverse to said lower apron, said projection element being carried in a manner that is adjustable in its position within the bottom apron along the length of the guidance zone in the direction of sliver travel and independently adjustable in its position perpendicular to the direction of sliver travel, and said projection element being fixed against movement once adjusted to a desired position so that a prescribed guided path may be defined between said top and bottom apron in said sliver guidance zone which may be configured to permit effective control of the sliver in said fiber guidance zone between said aprons.

2. The improvement of claim 1 wherein said transverse projection element is carried by a mount in a manner that said projection element may be adjusted in its position on said mount in a direction perpendicular to said guidance zone, and said mount may be adjusted along the length of said guidance zone.

3. The improvement of claim 2 wherein said projection means is mounted in such a manner that the distance said projection means may be moved away from said lower apron in said perpendicular direction is limited by preestablished positions.

4. The improvement of claim 3 wherein said projection means includes a transverse projection element extending transverse to sliver travel having at least one longitudinal flange arranged transverse to the direction of sliver travel in a manner that a flat surface is presented in engagement with said lower apron.

5. The improvement of claim 4 wherein said transverse projection element includes a roll which may be rotated.

6. The improvement of claim 5 wherein said projection element includes a roll disposed at a delivery end of said bottom apron.

7. The improvement of claim 1 wherein said projection means includes a plurality of projection elements carried along the length of said sliver guidance zone, each of said projection elements being carried in a manner that its distance from said guidance zone may be adjusted in a perpendicular direction and in a direction parallel to said guidance zone in the direction of sliver travel.

8. The improvement of claim 7 wherein at least one of said projection elements includes a flange which includes a generally flat surface for engaging said apron.

9. The improvement of claim 8 wherein at least one of said projection elements includes a roll carried at a delivery end of said lower apron.

* * * * *